United States Patent [19]

Fujimoto et al.

[11] Patent Number: 4,617,987

[45] Date of Patent: Oct. 21, 1986

[54] APPARATUS FOR CLEANING HEAT EXCHANGER TUBES

[75] Inventors: Masakazu Fujimoto; Naoyuki Inoue, both of Tokyo, Japan

[73] Assignee: Ebara Corporation, Japan

[21] Appl. No.: 816,627

[22] Filed: Jan. 6, 1986

Related U.S. Application Data

[62] Division of Ser. No. 678,780, Dec. 6, 1984, Pat. No. 4,583,586.

[51] Int. Cl.[4] ..... F28G 1/12; F28G 15/02

[52] U.S. Cl. ..... 165/95; 15/3.51

[58] Field of Search ..... 165/95; 15/3.51

[56] References Cited

U.S. PATENT DOCUMENTS 4,397,349 8/1983 Baron et al. ..... 165/95

4,398,592 8/1983 Baron et al. ..... 165/95

4,552,207 11/1985 Baron et al. ..... 165/95

FOREIGN PATENT DOCUMENTS 24196 2/1984 Japan ..... 165/95

*Primary Examiner*—Sheldon J. Richter

*Attorney, Agent, or Firm*—Steinberg & Raskin

[57] ABSTRACT

An improvement in apparatus for cleaning heat exchanger tubes wherein each tube has chambers at its opposite ends for capturing a tube cleaning element, such as a brush, which is adapted to move in opposite directions through the tube upon reversing the direction of flow of heat exchange fluid therethrough. The improvement comprises apparatus for detachably mounting the chambers to the ends of the respective tubes including a holder plate having openings formed therethrough at locations corresponding to locations of the ends of the heat exchanger tubes.

4 Claims, 4 Drawing Figures

APPARATUS FOR CLEANING HEAT EXCHANGER TUBES

This is a division of application Ser. No. 678,780, filed Dec. 6, 1984, now U.S. Pat. No. 4,583,586.

BACKGROUND OF THE INVENTION

The present invention relates generally to apparatus for cleaning heat exchanger tubes and, more particularly, to apparatus for cleaning heat exchanger tubes wherein each tube has a chamber at each of its opposite ends for capturing a tube cleaning element, such as a brush and a sponge ball. Such a tube cleaning element is adapted for movement in opposite directions through the tube upon reversing the direction of flow of heat exchange fluid therethrough by means of a valve arranged in a fluid inlet or outlet of the heat exchanger, so that the inner surface of the tube is cleaned by the moving tube cleaning element.

In conventional heat exchangers, spaced opposed front and rear enclosures are formed by partition plates for receiving heat exchange fluid. A bundle of heat exchange tubes whose ends are mounted to the partition plates fluidly extend between and communicate with the two enclosures. The chamber for capturing a cleaning element, such as a brush, is attached to each end of each exchanger tube and extends into the heat exchange fluid enclosure from the respective end of the heat exchanger tube. The cleaning element moves back and forth through the tube upon reversing the flow of heat exchange fluid so that the inner wall of the tube can be cleaned by the moving cleaning element.

The chamber for capturing the tube cleaning element is conventionally secured to a respective end of a heat exchange tube by means such as expanding the chamber within the tube end to tightly engage the same, by adhesive, or the like. For example, in one arrangement, a groove is formed around the inner surface of the end of a heat exchange tube in which an end of the chamber for capturing the cleaning element is inserted and then expanded to thereby tightly engage the end of the tube. On the other hand, the chamber for capturing the cleaning element is provided at its free end with a detachable stop member formed of an elastic material or the like which enables the cleaning element to be removed from the chamber.

Conventional arrangements by which chambers are secured to the ends of respective heat exchange tubes present problems in connection with the replacement of the cleaning elements when necessary due to wear or damage. In the arrangement described above, where the chamber is provided with a detachable stop member, although it is possible to easily remove the cleaning element for maintenance, since the chamber is mounted to the heat exchanger tube through an expansion of one of the members or through adhesion, significant amounts of labor and time are required in assembly, especially in heat exchangers which include a large number of heat exchanger tubes. Further, mounting of the chambers to the heat exchanger tubes through the enlargement of the chambers or tubes or through adhesion are not very reliable and the heat exchange tubes or chambers often crack due to excessive stresses created during expansion. Moreover it is possible for the chambers to become disengaged from the respective heat exchanger tubes due to insufficient engagement force so that they do not reliably engage the grooves formed around the inner surface of the tube ends.

SUMMARY OF THE INVENTION

Accordingly, it is an object of the present invention to provide apparatus for cleaning heat exchanger tubes which avoid the aforementioned disadvantages.

In particular, it an object of the present invention to provide a new and improved apparatus for cleaning heat exchanger tubes having chambers for capturing cleaning elements mounted at their respective ends, wherein the chambers are mounted to the ends of the heat exchanger tubes in a reliable manner and wherein the chambers are readily detachable from the heat exchanger tubes for maintenance of the tube cleaning elements.

Briefly, in accordance with the present invention, these and other objects are attained by providing an improvement in apparatus for cleaning heat exchanger tubes in which a bundle of tubes having opposite ends which are mounted to respective partition plates and communicate with forward and rearward heat exchange fluid enclosures wherein each end of each heat exchange tube is provided with a chamber for capturing a tube cleaning element adapted to move in opposite directions through the tube upon reversing the direction of flow of the heat exchange fluid therethrough so that the inner surface of the tube is cleaned by the moving tube cleaning element. The improvement comprises means for detachably mounting the chambers to respective ends of the heat exchanger tubes, the mounting means including holder plate means having openings formed therethrough at locations which correspond to the locations of the tube ends mounted to the respective partition plate, and means for mounting the holder plate means to the partition plate.

DETAILED DESCRIPTION OF THE DRAWINGS

Other and further objects, features and advantages of the invention will appear more fully from the following description taken in connection with the accompanying drawings, in which.

DESCRIPTION OF THE PREFERRED EMBODIMENT

Figure 1:
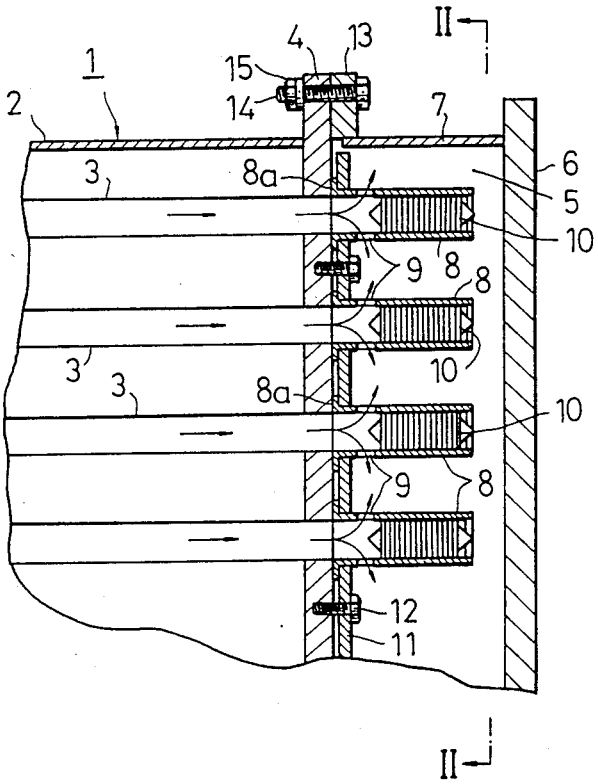
FIG. 1 is a fragmentary longitudinal sectional view of one embodiment of apparatus for cleaning heat exchanger tubes in accordance with the present invention.
Figure 2:
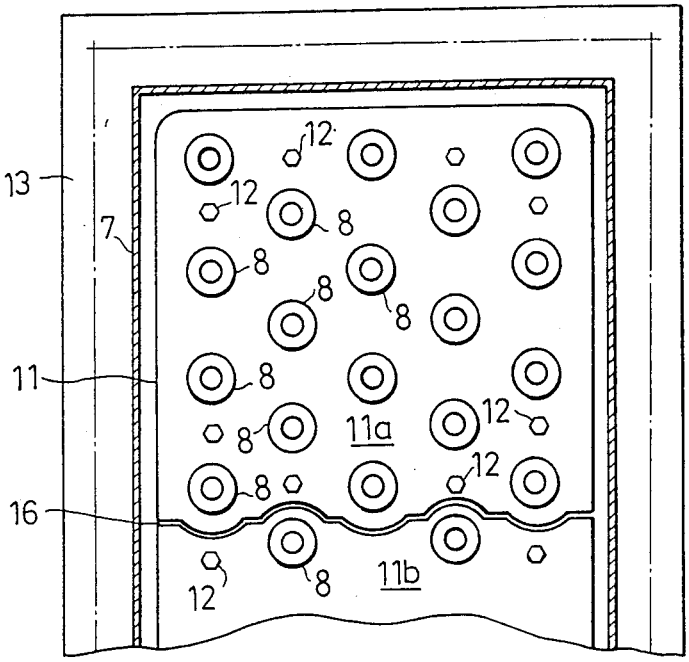
FIG. 2 is a transverse sectional view taken along line II—II of FIG. 1.

Referring now to the drawings wherein like reference characters designate identical or corresponding parts throughout the several views, and more particularly to FIGS. 1 and 2, a heat exchanger 1 incorporating the improvement of the present invention is illustrated. Heat exchanger 1 includes a housing 2 in which a bundle of elongate heat exchanger tubes 3 extend. The opposite ends (only one shown) of each heat exchanger tube 3 are securely mounted to a respective partition plate 4 (only one shown) such as by a press fit or the like. A pair of heat exchanger fluid enclosures 5 (only one shown) are arranged at the front and rear ends of the heat exchanger 1. Each enclosure is bounded by a respective partition plate 4, one of the front or rear end walls 6 (only one shown) and a side wall 7. Heat exchanger fluid introduced into one of the heat exchanger enclosures 5 is conducted to the other enclosure 5 through the heat exchanger tubes 3 by suitable conventional means (not shown) readily understood by those skilled in the art.

A chamber 8 for capturing a cleaning element 10 is fitted onto each end of a respective heat exchanger tube 3 by means of a holder plate 11. Each chamber 8 has openings 9 formed on its periphery at an end proximate to the end of the heat exchanger tube to which the chamber 8 is fitted.

The holder plate 11 has openings formed therethrough at locations which correspond to the locations of the ends of tubes 3 mounted to a respective partition plate 4. In the embodiment shown in FIGS. 1 and 2, a holder plate 11 is mounted to the respective partition plate 4 by threaded fasteners, such as bolts 12, which are screwed into threaded bores formed in the partition plate 4. A flange member 13 which is attached to one end of the side wall 7 defining the heat exchanger fluid enclosure 5 is secured to the partition plate 4 by bolts 14 and nuts 15.

The mounting of chambers 8 at a respective end of a heat exchanger tube 3 in accordance with the embodiment of FIGS. 1 and 2 is described below:

Each chamber 8 is integrally provided with a flange portion 8*a* which extends outwardly from its proximal end in a plane which is substantially perpendicular to the axis of the chamber 8. The flange portion 8*a* is held between the partition plate 4 and the holder plate 11 when the holder plate 11 is mounted to the partition plate so that the chamber 8 is held by the partition and holder plates as clearly seen in FIG. 1. Each chamber 8 may be pre-mounted to the holder plate 11 by inserting it through a corresponding opening in the holder plate until the flange portion 8*a* engages a side of the holder plate whereupon the latter, holding the chambers 8, is fixed to the partition plate 4 by bolts 12 thereby fitting the chambers 8 onto the ends of respective heat exchanger tubes 3.

As shown in FIG. 1, heat exchanger fluid flows in the right-hand direction of the illustrated arrows from a rearward heat exchanger fluid enclosure (not shown) to the forward enclosure 5 through the heat exchanger tubes 3 and the openings 9 formed in chambers 8. The cleaning elements 10 are kept in the illustrated position within the ends of the chamber 8 under the pressure of the flow of the heat exchanger fluid. When the direction of flow of the heat exchanger fluid is reversed in a conventional manner, such as through the operation of valves (not shown) connected to the enclosures 5, the cleaning elements 10 are moved from the illustrated forward or right-hand chambers 8 to the rearward chambers 8 (not shown) fitted to the opposite ends of tubes 3 through the tubes 3 by the fluid flow while the cleaning elements 10 clean the inner walls of the tubes 3.

In cases where the heat exchanger includes a great number of heat exchanger tubes 3, the holder plate 11 may be separated into a plurality of members 11*a* and 11*b* along a line of separation 16 shown in FIG. 2. Each of the members 11*a* and 11*b* is mounted independently to the partition plate 4 so as to facilitate assembly.

Figure 3:
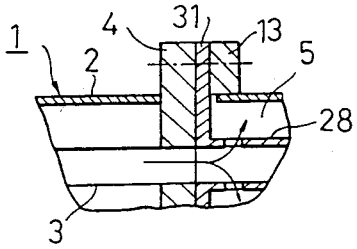
FIG. 3 is a fragmentary longitudinal sectional side view of another embodiment of apparatus for cleaning heat exchanger tubes in accordance with the present invention.

Referring to FIG. 3, another embodiment of apparatus for cleaning heat exchanger tubes incorporating the improvements of the present invention is illustrated. The construction of the apparatus illustrated in FIG. 3 is substantially the same as described above in connection with FIGS. 1 and 2, except that the chambers 28 for capturing the cleaning elements and the holder plate 31 are integrally formed as a one-piece unit. The holder plate 31 is mounted to the partition plate 4 by means of flange member 13 so that the chambers 28 are mounted to the ends of corresponding heat exchanger tubes 3.

Figure 4:
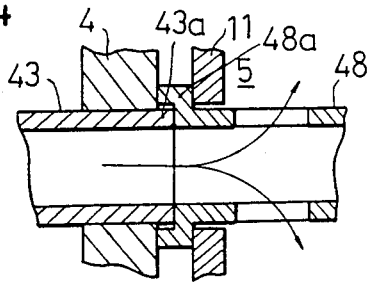
FIG. 4 is a fragmentary enlarged longitudinal sectional side view of a further embodiment of apparatus for cleaning heat exchanger tubes in accordance with the present invention.

Referring to FIG. 4, a further embodiment of apparatus for cleaning heat exchanger tubes comprising the improvement of the present invention is illustrated. This embodiment has essentially the same construction as that described above in connection with FIGS. 1 and 2 except that each end of the respective heat exchanger tube 43 has a portion which projects a short distance beyond the respective partition plate 4 into a respective heat exchanger fluid enclosure 5. Each respective chamber 48 for capturing a cleaning element is integrally provided with a flange portion 48*a* at its proximal end which has a stepped configuration adapted to fit over the projecting end portion 43*a* of a respective heat exchanger tube 43. The flange portion 48*a* of chamber 48 is held between the partition plates 5 and a holder plate 11 in the same manner as shown in FIG. 1 so that respective chambers 48 are fitted over the ends of respective heat exchanger tubes 43.

Thus, the present invention provides means for detachably mounting the chambers for capturing tube cleaning elements to respective ends of heat exchanger tubes. The mounting and demounting of the detachable chambers to and from the ends of the tubes can be carried out in a quick and easy manner by the holder plate which has a simple construction thereby resulting in savings in time and labor in the mounting and demounting of the chambers and, at the same time, high reliability of mounting is achieved.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for cleaning inner surfaces of heat exchanger tubes of a heat exchanger, wherein said heat exchanger includes a bundle of elongate heat exchanger tubes having opposite ends mounted to respective partition plates and communicating with respective forward and rearward heat exchanger fluid enclosures, each end of each of said heat exchanger tubes being provided with a chamber for capturing a tube cleaning element adapted to move in opposite directions through said tube upon reversing the direction of flow of heat exchanger fluid therethrough so that said inner surface of said tube is cleaned by the moving tube cleaning element, the improvement comprising:

said chambers being detachably mounted to respective ends of said tubes by mounting means including holder plate means having openings formed therethrough at locations corresponding to the locations of said tube ends mounted to a respective partition plate, and means for mounting said holder plate means to said partition plate, each chamber including an integral flange portion formed at one end thereof, said flange portion being held between said partition plate and said holder plate means, and said holder plate means being separated into at least two holder plate members.

2. The combination of claim 1 wherein said means for mounting said holder plate means to said partition plate includes threaded fastener means.

3. The combination of claim 1 wherein said chambers and holder plate means are integrally formed.

4. The combination of claim 1 wherein said heat exchange enclosure is partially bounded by a side wall and wherein said means for mounting said holder plate means to a respective partition plate includes a flange member connected to said side wall, said holder plate means being held between said partition plate and said flange member.

* * * * *